US012150559B2

(12) United States Patent
Yang

(10) Patent No.: US 12,150,559 B2
(45) Date of Patent: Nov. 26, 2024

(54) HIGHCHAIR

(71) Applicant: TJ(fujian) Industrial Co., Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 121 days.

(21) Appl. No.: 18/101,124

(22) Filed: Jan. 25, 2023

(65) Prior Publication Data

US 2023/0232998 A1 Jul. 27, 2023

(30) Foreign Application Priority Data

Jan. 26, 2022 (CN) ..... 202220207726.2

(51) Int. Cl.
*A47D 1/00* (2006.01)

(52) U.S. Cl.
CPC ..... *A47D 1/0085* (2017.05); *A47D 1/0081* (2017.05)

(58) Field of Classification Search
CPC .... A47D 1/023; A47D 1/0081; A47D 1/0083; A47D 1/0085; A47D 1/002; A47D 1/004; A47D 1/006; A47D 1/008
See application file for complete search history.

(56) References Cited

U.S. PATENT DOCUMENTS 5,071,192 A * 12/1991 Adler ..... A47D 1/0085 297/464
5,489,138 A * 2/1996 Mariol ..... A47D 1/0085 297/344.14
5,992,932 A * 11/1999 Kain ..... A47D 1/0085 297/151
6,024,412 A * 2/2000 Kain ..... A47D 1/0081 297/149
7,201,445 B1 * 4/2007 Dubiel ..... A47D 1/103 297/256.13
10,722,046 B1 * 7/2020 Poslowski ..... A47D 1/004

FOREIGN PATENT DOCUMENTS

CA 2598741 A1 * 2/2009 ..... A47D 1/004

* cited by examiner

*Primary Examiner* — Milton Nelson, Jr.
(74) *Attorney, Agent, or Firm* — Bayramoglu Law Offices LLC

(57) ABSTRACT

A highchair includes a base, and a cloth-covered seat provided on the base. A feeding tray is provided at a front end of the cloth-covered seat, and two support rods are arranged on the left and right of the cloth-covered seat. A top portion of each support rod is provided with a post hole. Two cover boxes are symmetrically arranged on the left and right under the feeding tray. Each cover box is internally provided with a handle. One end of the handle protrudes out of the cover box. Each of the cover boxes is internally provided with a lifting member. An insertion post is provided at a bottom portion of the lifting member. The insertion post is corresponding to the post hole, and is able to be inserted into the corresponding post hole by passing through a bottom portion of the cover box.

5 Claims, 5 Drawing Sheets

HIGHCHAIR

CROSS REFERENCE TO THE RELATED APPLICATIONS

This application is based upon and claims priority to Chinese Patent Application No. 202220207726.2, filed on Jan. 26, 2022, the entire contents of which are incorporated herein by reference.

TECHNICAL FIELD

The present invention relates to the field of highchairs, in particular to a highchair.

BACKGROUND

Highchairs are special chairs for feeding children. Highchairs can help children develop the habit of sitting for eating, avoiding the trouble of chasing for feeding. Children can sit steadily in a suitable highchair, and their hands can be freed to grasp tableware, which exercises the coordination of children's hands, eyes and brain. The existing highchair includes a base, and a seat provided on the base, and a feeding tray is provided at a front end of the seat. The feeding tray in the existing highchair is fixedly connected, and can be only directly installed or removed. Thus, the child must be held by an adult to get in and out of the highchair, which brings great inconvenience.

SUMMARY

An objective of the present invention is to provide a highchair, which solves the problem that the existing highchair requires an adult to hold the child to get in and out of the highchair.

To solve the above technical problem, the present invention adopts the following technical solution:

A highchair includes a base, and a cloth-covered seat provided on the base; a feeding tray is provided at a front end of the cloth-covered seat, and two support rods are arranged on the left and right of the cloth-covered seat; a top portion of each of the two support rods is provided with a post hole; two cover boxes are symmetrically arranged on the left and right under the feeding tray; each of the cover boxes is internally provided with a handle that is able to be pulled horizontally; one end of the handle protrudes out of the cover box; each of the cover boxes is internally provided with a lifting member that is able to be lifted up with movement of the handle; an insertion post is provided at a bottom portion of the lifting member; and the insertion post is corresponding to the post hole, and is able to be inserted into the corresponding post hole by passing through a bottom portion of the cover box.

Further, a top surface of each of the cover boxes may be provided with an accommodating slot; the handle may include a handle body and a driving member that may be connected to each other; the handle body may be located outside the cover box, and the driving member may be located in the accommodating slot; the accommodating slot may be internally provided with a positioning post, and the positioning post may be provided with a notch; the lifting member may be located in the notch; the insertion post may be provided at the bottom portion of the lifting member; the driving member may be provided with a movement slot; the positioning post may be located in the movement slot; the movement slot may be internally provided with a first spring abutting against the positioning post; and an end of the movement slot adjacent to the lifting member may be provided with a front inclined surface and a rear inclined surface that may be symmetrical to each other.

Further, the bottom portion of the cover box may be provided with a rod slot with an open rear end; left and right sides of the rod slot may be respectively provided with a left sliding slot and a right sliding slot; the top portion of each of the support rods may be provided with a clamping edge portion located between the left sliding slot and the right sliding slot; the rear end of the rod slot may be trumpet-shaped; an outer periphery of an upper half of each of the support rods may define an arc surface with a diameter gradually decreasing from bottom to top; a rear end of a bottom portion of the insertion post may be provided with an inclined surface inclined from rear to front; and a second spring may be provided between a top surface of the lifting member and a bottom surface of the feeding tray.

Further, the base may include four support legs distributed at four corners of the base; two cross-hinged connecting rods may be provided between every two adjacent support legs, and two ends of each of the two connecting rods may be hinged to the two adjacent support legs; short support posts may be respectively provided on two front support legs, and long support posts may be respectively provided on two rear support legs; each of the support rods may be corresponding to one short support post; the short support posts and the long support posts all extend into the cloth-covered seat, and top portions of the short support posts extend out of the cloth-covered seat; and a bottom portion of each of the support rods may be connected to the top portion of the corresponding short support post.

Further, a bottom surface of each of the four support legs may be provided with a rubber pad.

According to the description of the present invention, compared with the prior art, the present invention has the following advantages. The present invention has a novel structure and clever design. The feeding tray is detachably connected to the cloth-covered seat. To remove the feeding tray, the two handles are pulled outward, such that the lifting members are lifted up, and the insertion posts of the lifting members are disengaged from the corresponding post holes. Thus, the feeding tray can be removed. To get the child in and out of the highchair, one of the handles is pulled outward, such that the lifting member corresponding to the handle is lifted up, and the insertion post of the lifting member is disengaged from the corresponding post hole. At this time, the insertion post of the lifting member corresponding to the other handle can be used as a rotating shaft, around which the feeding tray can be rotated. Thus, the child can get in and out of the highchair from the front side of the cloth-covered seat, avoiding the need for an adult to hold the child.

DETAILED DESCRIPTION OF THE EMBODIMENTS

Figure 1:
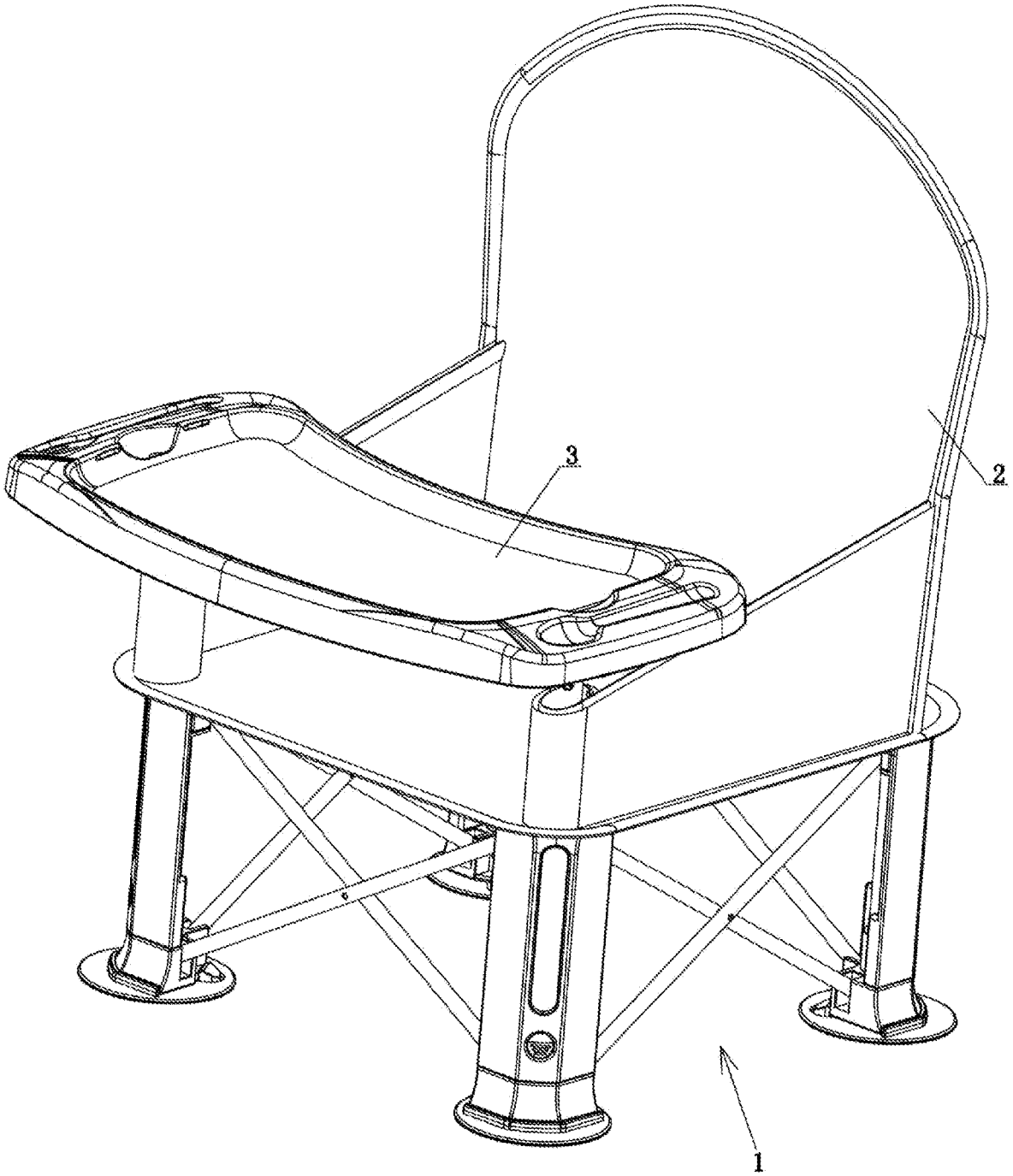
FIG. 1 is a structural view of a highchair according to the present invention.
Figure 2:
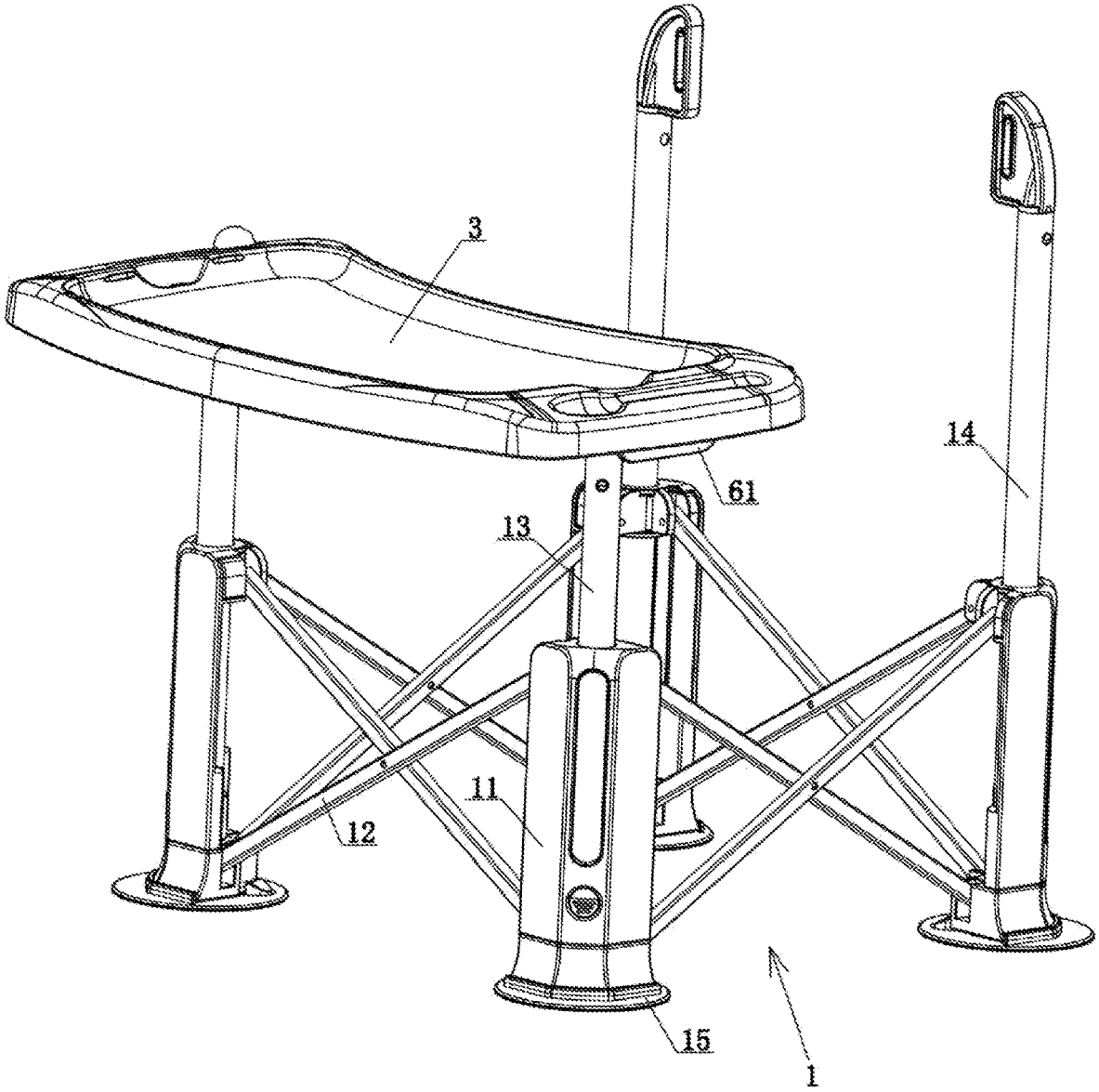
FIG. 2 is a structural view of the highchair after a cloth-covered seat is removed according to the present invention.

Referring to FIGS. 1 to 5, a highchair includes a base 1, and a cloth-covered seat 2 provided on the base 1. A feeding tray 3 is provided at a front end of the cloth-covered seat 2, and two support rods 4 are arranged on the left and right of the cloth-covered seat. A top portion of each of the two support rods 4 is provided with a post hole 41. Two cover boxes 5 are symmetrically arranged on the left and right under the feeding tray 3. Each of the cover boxes 5 is internally provided with a handle 6 that is able to be pulled horizontally. One end of the handle 6 protrudes out of the cover box 5. Each of the cover boxes 5 is internally provided with a lifting member 7 that is able to be lifted up with movement of the handle 6. An insertion post 8 is provided at a bottom portion of the lifting member 7. The insertion post 8 is corresponding to the post hole 41, and is able to be inserted into the corresponding post hole 41 by passing through a bottom portion of the cover box 5.

Figure 3:
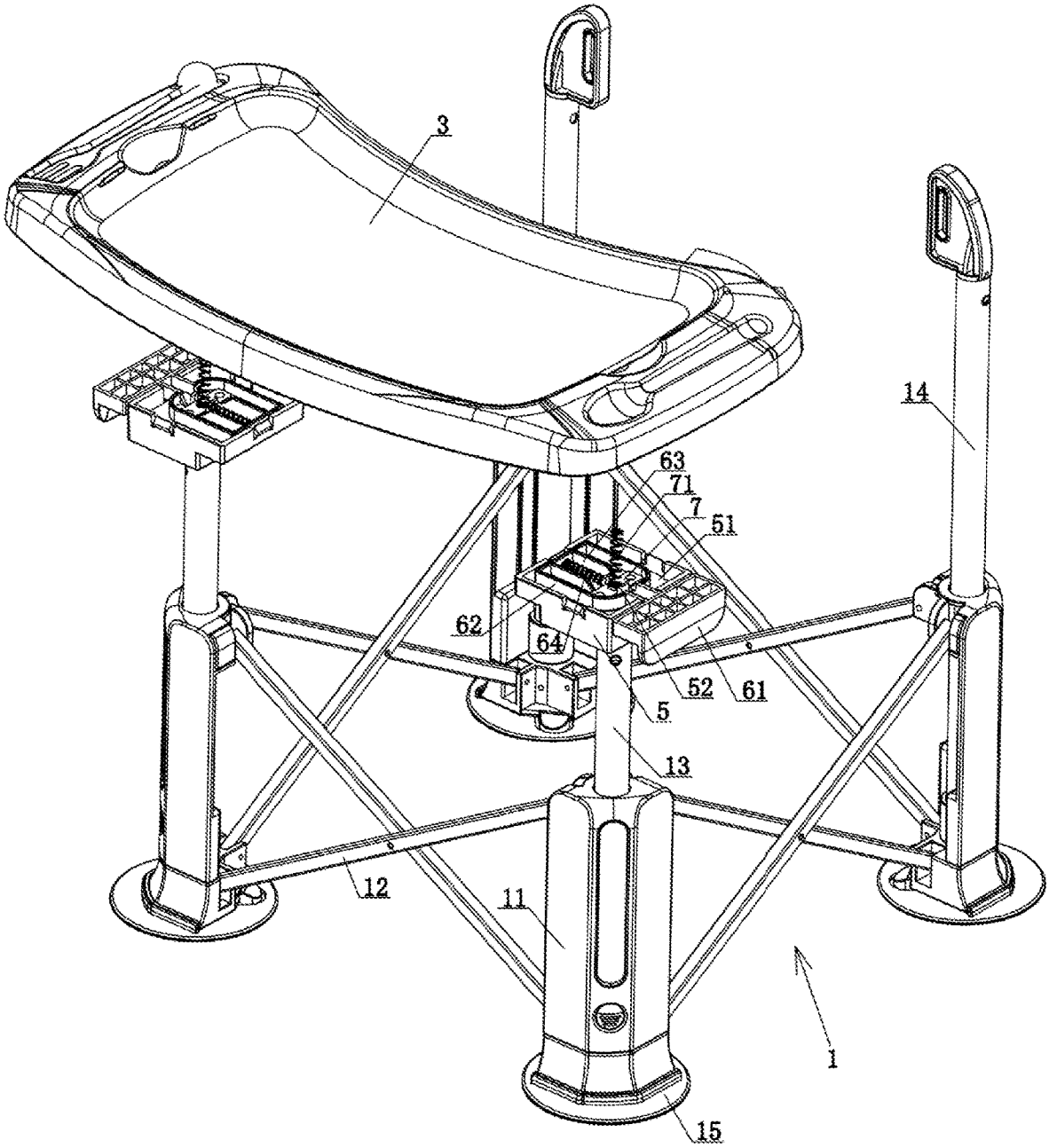
FIG. 3 is an exploded view of the highchair according to the present invention.
Figure 4:
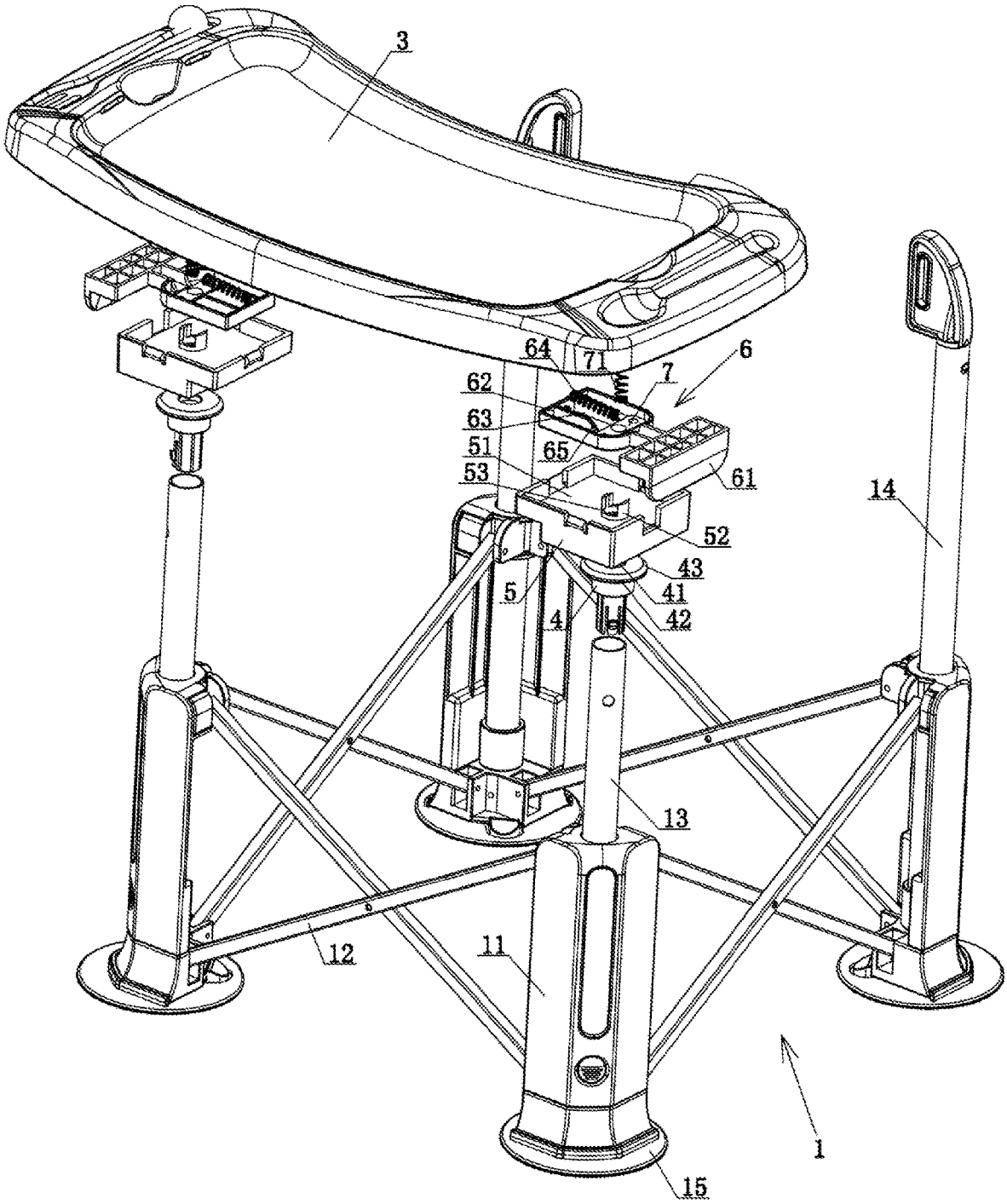
FIG. 4 is a further exploded view of the highchair shown in FIG. 3.
Figure 5:
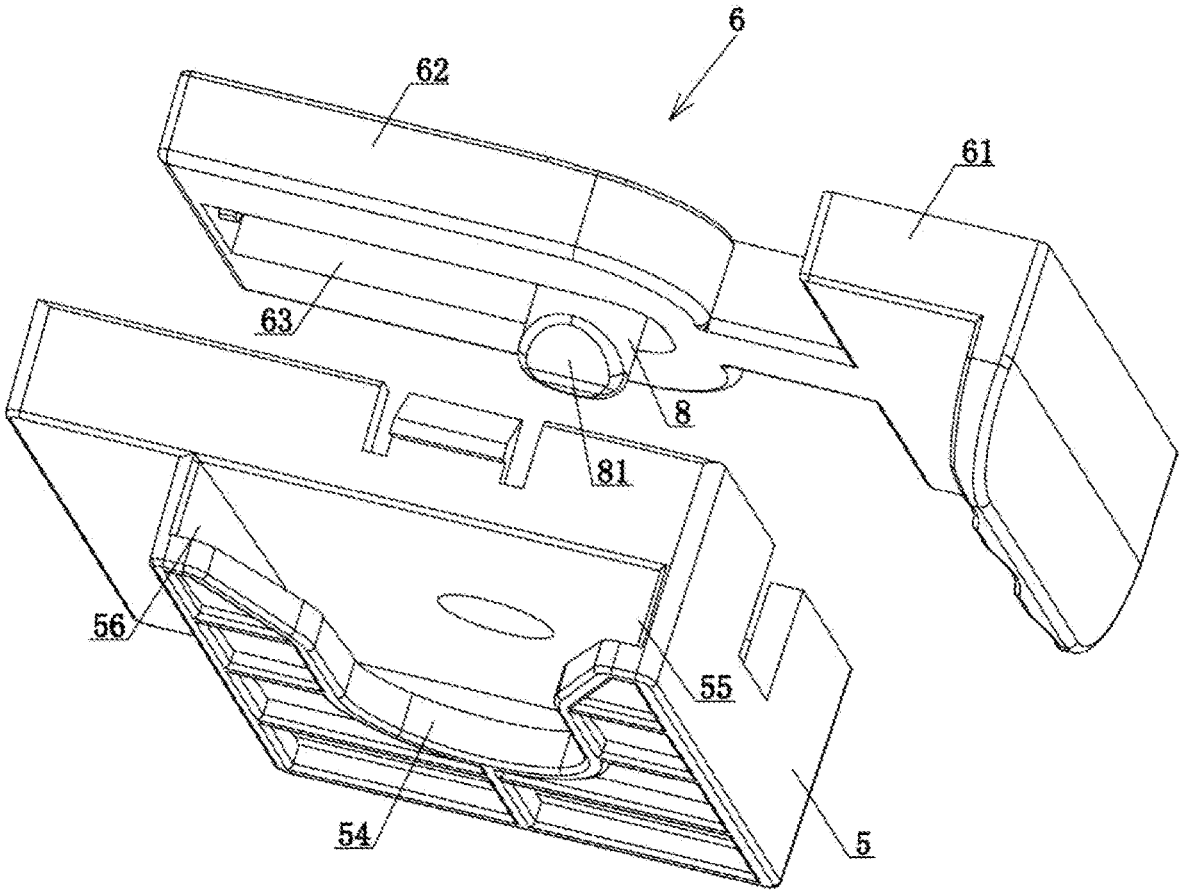
FIG. 5 is a structural view of a handle disengaged from a cover box according to the present invention.

Referring to FIGS. 3 to 5, a top surface of each of the cover boxes 5 is provided with an accommodating slot 51. The handle 6 includes a handle body 61 and a driving member 62 that are connected to each other. The handle body 61 is located outside the cover box 5, and the driving member 62 is located in the accommodating slot 51. The accommodating slot 51 is internally provided with a positioning post 52, and the positioning post 52 is provided with a notch 53. The lifting member 7 is located in the notch. The insertion post 8 is provided at the bottom portion of the lifting member 7. The driving member 62 is provided with a movement slot 63. The positioning post 52 is located in the movement slot 63. The movement slot 63 is internally provided with a first spring 64 abutting against the positioning post 52. An end of the movement slot 63 adjacent to the lifting member 7 is provided with a front inclined surface 65 and a rear inclined surface 65 that are symmetrical to each other.

Referring to FIGS. 4 and 5, the bottom portion of the cover box 5 is provided with a rod slot 54 with an open rear end. Left and right sides of the rod slot 54 are respectively provided with a left sliding slot 55 and a right sliding slot 56. The top portion of each of the support rods 4 is provided with a clamping edge portion 42 located between the left sliding slot 55 and the right sliding slot 56. The rear end of the rod slot 54 is trumpet-shaped. An outer periphery of an upper half of each of the support rods 4 defines an arc surface 43 with a diameter gradually decreasing from bottom to top. A rear end of a bottom portion of the insertion post 8 is provided with an inclined surface 81 inclined from rear to front. A second spring 71 is provided between a top surface of the lifting member 7 and a bottom surface of the feeding tray 3.

Referring to FIGS. 1 to 5, to install the feeding tray 3, the clamping edge portion 42 of each of the support rods 4 is aligned with the left sliding slot 55 and the right sliding slot 56, and the feeding tray 3 is pushed rearward. When the clamping edge portion 42 abuts against the insertion post 8, the arc surface 43 is matched with the inclined surface 81. When the feeding tray 3 is continuously pushed rearward, the lifting member 7 is automatically lifted up. When the insertion post 8 is aligned with the post hole 41, the insertion post 8 falls into the post hole 41, thereby fixing the feeding tray 3. To remove the feeding tray 3, the two handles 6 are pulled outward. The two inclined surfaces 65 of the driving member 62 drive the lifting member 7 to lift up, such that the insertion post 8 is disengaged from the corresponding post hole 41. Thus, the feeding tray 3 can be pulled forward and removed. To get the child in and out of the highchair, one of the handles 6 is pulled outward, such that the insertion post 8 of the lifting member 7 corresponding to the handle 6 is disengaged from the corresponding post hole 41. At this time, the insertion post 8 of the lifting member 7 corresponding to the other handle 6 can be used as a rotating shaft, around which the feeding tray 3 can be rotated.

Referring to FIGS. 1 to 4, the base 1 includes four support legs 11 distributed at four corners of the base 1. Two cross-hinged connecting rods 12 are provided between every two adjacent support legs 11, and two ends of each of the two connecting rods 12 are hinged to the two adjacent support legs 11. Short support posts 13 are respectively provided on two front support legs 11, and long support posts 14 are respectively provided on two rear support legs 11. Each of the support rods 4 is corresponding to one short support post 13. The short support posts 13 and the long support posts 14 all extend into the cloth-covered seat 2, and top portions of the short support posts 13 extend out of the cloth-covered seat 2. A bottom portion of each of the support rods 4 is connected to the top portion of the corresponding short support post 13. The connection between the cloth-covered seat 2 and the base 1 is simple and convenient. That is, the short support posts 13 and the long support posts 14 are directly inserted into the cloth-covered seat 2, and a bottom portion of the cloth-covered seat 2 abuts against the top portions of the four support legs 11. The four support legs 11 and the two connecting rods 12 between every two adjacent support legs 11 are folding, which greatly reduces the packaging space. When folding the four support legs 11 and the two connecting rods 12 between every two adjacent support legs 11, both hands can grasp the outer peripheries of the support legs 11, thereby effectively preventing the hands from being pinched. A bottom surface of each of the four support legs 11 is provided with a rubber pad 15. The rubber pad 15 increases the friction between the support legs 11 and the ground, and achieves a desired anti-slip effect.

In addition, the highchair of the present invention can be used as a booster on an adult chair.

The above described are merely specific implementations of the present invention, but the design concept of the present invention is not limited thereto. Any non-substantial changes made to the present invention based on the concept of the present invention should fall within the protection scope of the present invention.

What is claimed is:

1. A highchair, comprising a base, and a cloth-covered seat provided on the base, wherein a feeding tray is provided at a front end of the cloth-covered seat, and two support rods are arranged on left and right sides of the cloth-covered seat; a top portion of each support rod of the two support rods is provided with a post hole; two cover boxes are symmetrically arranged on the left and right sides under the feeding tray; each cover box of the two cover boxes is internally provided with a handle, wherein the handle is configured to be pulled horizontally; one end of the handle protrudes out of each cover box; each cover box is internally provided with a lifting member, wherein the lifting member is configured to be lifted up with movement of the handle; an insertion post is provided at a bottom portion of the lifting member; and the insertion post is corresponding to the post hole, and the insertion post is configured to be inserted into the post hole by passing through a bottom portion of each cover box.

2. The highchair according to claim 1, wherein a top surface of each cover box is provided with an accommodating slot; the handle comprises a handle body and a driving member, wherein the handle body and the driving member are connected to each other; the handle body is located outside each cover box, and the driving member is located in the accommodating slot; the accommodating slot is internally provided with a positioning post, and the positioning post is provided with a notch; the lifting member is located in the notch; the insertion post is provided at the bottom portion of the lifting member; the driving member is provided with a movement slot; the positioning post is located in the movement slot; the movement slot is internally provided with a first spring abutting against the positioning post; and an end of the movement slot is provided with a front inclined surface and a rear inclined surface, wherein the end of the movement slot is adjacent to the lifting member, and the front inclined surface and the rear inclined surface are symmetrical to each other.

3. The highchair according to claim 1, wherein the bottom portion of each cover box is provided with a rod slot with an open rear end; left and right sides of the rod slot are respectively provided with a left sliding slot and a right sliding slot; the top portion of each support rod is provided with a clamping edge portion located between the left sliding slot and the right sliding slot; the open rear end of the rod slot is trumpet-shaped; an outer periphery of an upper half of each support rod defines an arc surface with a diameter gradually decreasing from bottom to top; a rear end of a bottom portion of the insertion post is provided with an inclined surface inclined from rear to front; and a second spring is provided between a top surface of the lifting member and a bottom surface of the feeding tray.

4. The highchair according to claim 1, wherein the base comprises four support legs distributed at four corners of the base; two cross-hinged connecting rods are provided between every two adjacent support legs of the four support legs, and two ends of each of the two cross-hinged connecting rods are hinged to the every two adjacent support legs; short support posts are respectively provided on two front support legs of the four support legs, and long support posts are respectively provided on two rear support legs of the four support legs; the two support rods are respectively corresponding to the short support posts; the short support posts and the long support posts extend into the cloth-covered seat, and top portions of the short support posts extend out of the cloth-covered seat; and bottom portions of the two support rods are respectively connected to the top portions of the short support posts.

5. The highchair according to claim 4, wherein a bottom surface of each of the four support legs is provided with a rubber pad.

* * * * *